US005154147A

United States Patent [19]

Muroki

[11] Patent Number: 5,154,147

[45] Date of Patent: Oct. 13, 1992

[54] ROTARY VALVE

[76] Inventor: Takumi Muroki, 2-16 2chome Fujimi, Chiba-shi Chiba-ken 280, Japan

[21] Appl. No.: 682,741

[22] Filed: Apr. 9, 1991

[51] Int. Cl.[5] ..... F01L 7/02; F01L 7/16

[52] U.S. Cl. ..... 123/190.17; 123/190.8; 123/190.4

[58] Field of Search ..... 123/190 E, 190 BD, 190 B, 123/190 BB, 80 R; 251/160

[56] References Cited

U.S. PATENT DOCUMENTS

| | | | |
|---|---|---|---|
| Re. 13,108 | 5/1910 | Frayer et al. | 123/190 BD |
| 3,730,161 | 5/1973 | Deane | 123/190 BD |
| 3,945,364 | 3/1976 | Cook | 123/190 BD |
| 4,019,487 | 4/1977 | Guenther | 123/190.17 |
| 4,022,178 | 5/1977 | Cross et al. | 123/190 E |
| 4,077,382 | 3/1978 | Gentile | 123/190.1 |
| 4,342,294 | 8/1982 | Hopkins | 123/190 B |
| 4,467,751 | 8/1984 | Asaka et al. | 123/190 E |
| 4,794,895 | 1/1989 | Kruger | 123/190 E |

FOREIGN PATENT DOCUMENTS

| | | | |
|---|---|---|---|
| 3241723 | 5/1984 | Fed. Rep. of Germany | 123/190 E |
| 258119 | 4/1928 | Italy | 123/190 BD |

*Primary Examiner*—E. Rollins Cross
*Assistant Examiner*—Erick Solis
*Attorney, Agent, or Firm*—Frishauf, Holtz, Goodman & Woodward

[57] ABSTRACT

A rotary valve, having a cylindrical rotor mounted within a cylindrical bore in a casing with a predetermined clearance defined between the cylindrical surface of the rotor and the cylindrical edge surface of the bore, a first seal sealing posible leaks of a gas from a selectively fluidly connecting arrangement in the rotor in the axial direction of the rotor, and a second means seal sealing possible leaks of the gas from the connecting arrangement in the radial direction of the rotor. The casing has part of the first and second seals which is attached thereto. A combination of the clearance and the first and second seals enables the rotor to rotate with a low friction.

16 Claims, 10 Drawing Sheets (A)

(B)

(C)

(D)

(E)

(F)

ROTARY VALVE

BACKGROUND OF THE INVENTION

1. Field of the Invention

The present invention relates generally to an improved rotary valve and more particularly to an improved rotary valve appropriately providing an intake and exhaust valve for internal-combustion engines, e.g., gasoline engines and diesel engines.

2. Description of the Related Art

Prior-art intake and exhaust valves of four-cycle internal-combustion engines which have been provided until now are classified into the following categories: a first form including a valve body which rises perpendicularly from its seat and falls perpendicularly thereon and a second form including a valve body which is in sliding contact with its seat within a valve casing. The first form of the intake and exhaust valves is a poppet valve. The second form comprises a sleeve valve including a sleeve-shaped valve body slidably mounted within engine cylinder and a rotary valve including a valve body which is slidably rotatably mounted within a seat.

At the present time, a poppet valve is predominantly used for intake and exhaust valves of four-cycle gasoline engines. Since the poppet valve has a high sealability, high lubricatability and high reliability, it is predominantly used for practical intake and exhaust valves of an automotive internal-combustion engine. However, the poppet valve is not always suitable for use in a high-speed internal-combustion engine. A camshaft driven poppet valve presently tends to be predominantly used in an internal-combustion engine for passenger car. The camshaft driven poppet valve is yet limited so that a use of it may result in a rapid reduction in engine volumetric efficiency or a destruction of the high-speed engine in an extreme case.

In detail, since the camshaft driven poppet valve is a relatively low rigid, elastic system, a resonance of one of normal vibrations of this system with one of harmonic components of a camming force exerted by the camshaft may cause the operational sequence of the system to be irregular so that a component of the poppet valve jumps and a valve spring exerting its force on the poppet goes out of its normal operation to a surging. An engine in such state produces a high noise, causes the operational timing of the poppet to go out of order and rapidly reduces its power.

Thus, the camshaft driven poppet valve develops the above problems because of its constitution as engine speed increases. In order to overcome the problems in the camshaft driven poppet valve, various non-poppet valves have been proposed and experimentally manufactured. However, all developments of these non-poppet valves have failed and nothing of the various non-poppet valves has been yet realized.

First, a lift valve of the non-poppet valves fails to fit high-speed engine, entails a complication in an operating mechanism for a valve body and produces much noise and low antiknock quality on engine.

Second, the sleeve valve, one form of slide valves, produces a high antiknock quality on engine and includes an operating mechanism for the sleeve more simplified in structure than the operating mechanism for a poppet of the poppet valve. The sleeve valve entails problems in a heat exhaust and a lubrication so that it fails to fit high-speed engine. The sleeve valve also produces an unsatisfactory noise.

Rotary valves are classified into a plurality of categories in accordance with configurations of rotors and arrangements of passages for combustible gas or air and exhaust gas. Since a prior-art intake and exhaust rotary valve includes in principle a rotor revolving at a uniform speed in sliding contact with a seat surface having open edges of intake and exhaust and a combustion chamber to periodically open and shut communications of the intake and the exhaust and combustion chamber, it is best appropriate to a high-speed engine. In particular, it provides a greater opening speed in the communications of the intake and the exhaust and combustion chamber than the poppet valve.

The following drawbacks seem to have blocked an actual use of the rotary valve as the intake and exhaust valve for automotive engine until now although the rotary valve has the above advantages: (i) The rotary valves have a poor sealability in principle. (ii) Therefore, providing a means for pushing the rotor on a seat surface in order to improve the sealability of the rotary valve impairs a smooth operation of the rotor to deteriorate the essential advantages of the rotary valve. In other words, the rotor must smoothly revolve and produce a low friction and low wear, and a lubricating oil consumption of the rotary valve must be low.

FIG. 12 illustrates a Minerva (a motorcar manufacturing corporation in Belgium) type rotary valve. The cylindrical surface of a rotor indicated at 50 has indentations 51*a*, 51*b* and 51*c*. In accordance with the FIG. 12 position of the rotary valve, two lands adjoining the circumferentially opposite edges of the indentation 51*c* shut a combustion chamber 52 from an intake 53 and an exhaust 54. A rotor 50 further goes from the FIG. 12 position in the direction of the arrow A to open the combustion chamber 52 to the intake 53. Then, a further rotation of the rotor 50 shuts the combustion chamber 52 from the intake 53 while a combustion is performed within the combustion chamber 52. Then, a further rotation of the rotor 50 enables the indentation 51*b* to open the combustion chamber 52 to the exhaust 54 to exhaust the combustion chamber 52.

FIG. 13 illustrates a sealing arrangement of the FIG. 12 rotary valve. This sealing arrangement comprises a wedge 56 positionally controlled by a control assembly including a screw 55. As seen in FIG. 13, a rightward movement of the wedge 56 more forcibly urges the rotor 50 on sliding-contact surfaces 55*a* and 55*b* of a cylinder block through the retainer 57 to better seal the open edge of the exhaust 54 in the seat contact surfaces 55*a* and the top open edge of the combustion chamber 52 in the sliding-contact surfaces 55*b*.

In accordance with the Minerva-type rotary valve, a relatively large contact surface area between the cylindrical surface of the rotor and sliding-contact surfaces and an increased contact pressure of the rotor on the sliding-contact surfaces secure the sealability of the rotary valve, so that a frictional resistance to the rotor is large and a lubrication for the rotor entails a problem to greatly reduce the essential advantages of the rotary valve. That is, an increase in the sealability and a reduction in the frictional resistance are in an opposite relation so that a reduced frictional resistance to the rotor reduces the sealability of the rotary valve and on the other hand, an increased sealability of the rotary valve increases the frictional resistance to the rotor.

Since the contact pressure of the rotor is constant and sufficiently large to secure the sealability of the rotary valve when an engine receives a maximum load, it causes a high frictional resistance to the rotor when the engine receives a low load so that the rotor slowly rotates.

A Baer type sleeve-shaped rotary valve and a flat-rotor type rotary valve assembly realized in United Kingdom in 1930 in which a perforated flat integral rotor is arranged within each of intake and exhaust passages for engine cylinders and rotates to perform intake and exhaust strokes of the engine cylinders were proposed. These rotary valves entailed essentially the same drawbacks as the Minerva type rotary valve and failed to be actually used. As understood from the above, the most important problem in the rotary valve is to secure the sealability.

SUMMARY OF THE INVENTION

An object of the present invention is to provide a rotary valve in which a low frictional resistance to a rotor secures a smooth rotation of the rotor so that the rotary valve has an increased sealability as well as functional natures, i.e., a good high-speed performance and good quietness. In order to achieve the object, the present invention comprising: a casing having a wall defining a cylindrical bore having an end surface, said casing having a first opening for taking in a first gas, said casing having a second opening for discharging a second gas and a third opening communicating with a chamber, the chamber taking in the first gas and discharging the second gas; a rotor including a cylindrical portion mounted within said bore with a predetermined clearance defined between the cylindrical surface of the cylindrical portion of said rotor and the cylindrical edge surface of said bore, said rotor including means for selectively fluidly connecting the first and second openings to the third opening; first means for sealing possible leaks in the first and second gases from the selectively fluidly connecting means in the axial direction of said rotor; and second means for sealing possible leaks in the first and second gases from the selectively fluidly connecting means in the radial direction of said rotor, said casing having part of the first and second sealing means which is attached thereto, said first sealing means including a surface in sliding contact with part of a surface of said rotor and a surface of the wall of said casing opposite to said surface of said rotor in a revolution of said rotor, said second sealing means including a surface in sliding contact with part of the cylindrical surface of said rotor in the revolution of said rotor. The predetermined clearance between the cylindrical surface of the rotor and the cylindrical edge surface of the bore enables the rotor to rotate with a low friction. The first and second sealing means can produce a less friction to the rotor to facilitate a high-speed rotation of the rotor, thus increasing a service life of the rotary valve.

DESCRIPTION OF THE PREFERRED EMBODIMENTS

The preferred embodiments of the present invention will be described with reference to the drawings hereinafter.

Figure 1:
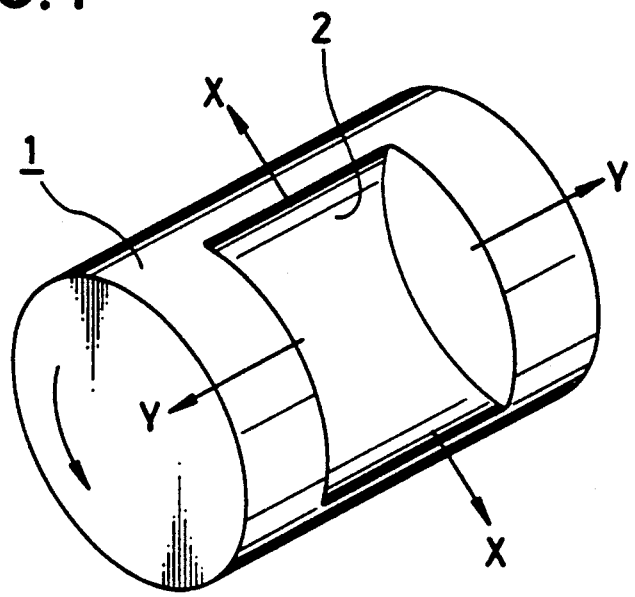
FIG. 1 is a perspective view of a notched cylindrical rotor of a rotary valve of the present invention.
Figure 2:
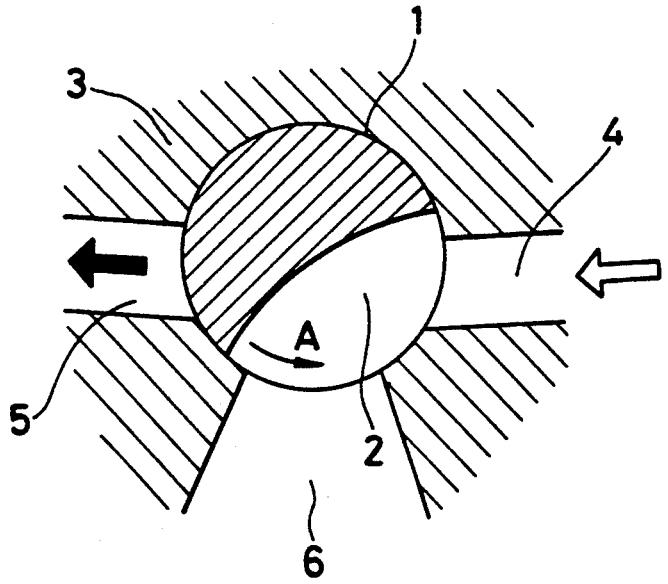
FIG. 2 is a schematic cross-section of the FIG. 1 rotary valve.
Figure 3:
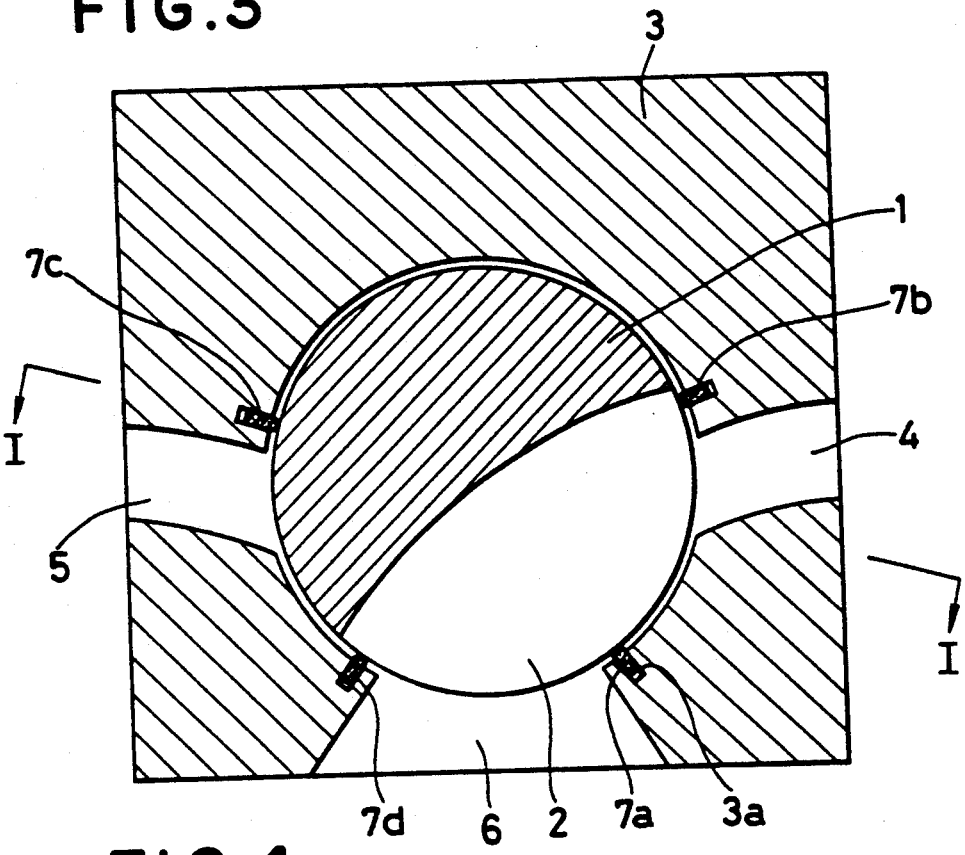
FIG. 3 is a schematic cross-section of the FIG. 1 rotary valve with radial seals seated within a predetermined clearance between the cylindrical surface of the notched rotor and cylindrical edge surfaces of the bore in the wall of the valve casing.
Figure 4:
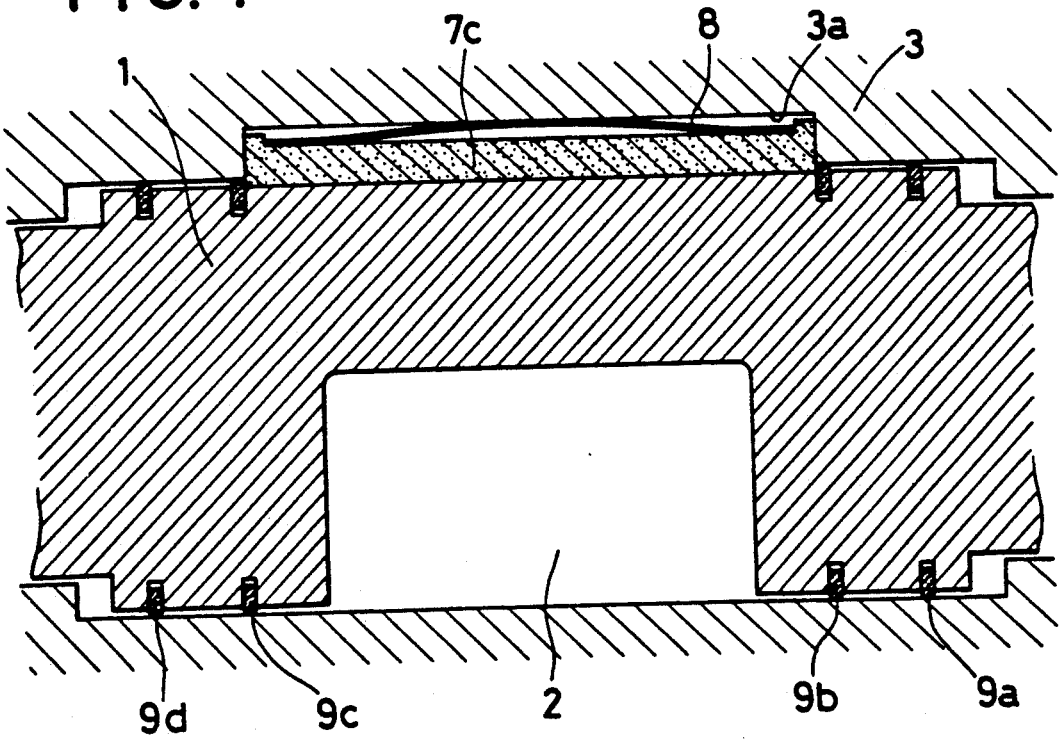
FIG. 4 is a longitudinal section taken along I—I line in FIG. 3.

FIGS. 1 through 4 illustrate the essence of a rotary valve according to a first embodiment of the present invention. As shown in FIG. 1, a rotor 1 is generally a solid round cylinder and defines a single indentation 2 extending axially thereof and having the opposite end surfaces. As shown in FIGS. 2 through 4, the rotor 1 is slidably rotatably mounted within a bore defined in an engine cylinder head 3 of an internal-combustion engine and revolves in the direction of the arrow A at a ½ speed of engine speed.

An intake 4 and an exhaust 5 which can communicate with the indentation 2 defined in the rotor 3 are oppositely defined through an combustion chamber 6 in the wall of the engine cylinder head 3.

A revolution of the rotor 1 in the direction of the arrow A sequentially opens the combustion chamber 6 to the intake 4 for an intake of combustible gas, shuts the combustion chamber 6 from the intake 4 and exhaust and 5 for a compression and combustion of combustible gas and opens the combustion chamber 6 to the exhaust 5 for an exhaust of the combustion chamber 6. Thus, continued revolutions of the rotor 1 in the direction of the arrow A enable the engine to continuously run.

Since in the operation of the above rotary valve, both combustible gas and exhaust gas tend to leak out of the indentation 2 in the radial direction X and the axial direction Y in FIG. 1, the rotary valve requires in nature seals in order to prevent the leaks of combustion and exhaust gases in the directions X and Y.

FIGS. 3 and 4 illustrate arrangements of the seals of the rotary valve. FIG. 3 illustrates an arrangement of radial seals, i.e., bar-shaped seals extending axially of the rotor 1 (see FIG. 4) in order to prevent a leak of a gas in the radial direction X of the rotor 1. FIG. 4 illustrates an arrangement of ring seals preventing a leak of a gas in the axial direction Y of the rotor 1.

As seen in FIGS. 3 and 4, the radial seals 7*a*, 7*b*, 7*c* and 7*d* are placed within grooves 3*a* defined in the engine cylinder head 3. The radial seal 7*a* is placed within a groove 3*a* defined near one side of the top open edge of the combustion chamber 6. The radial seal 7*b* is placed within a groove 3*a* defined near a side of the open edge of the intake 4 remote from the combustion chamber 6. The radial seal 7*c* is placed within a groove 3*a* defined near a side of the open edge of the exhaust 5 remote from the combustion chamber 6. The radial seal 7*d* is placed within a groove 3*a* defined near the other side of the top open edge of the combustion chamber 6. Herein, the term "axial direction of rotor" indicating the orientation of each of the radial seals 7*a* to 7*d* is not rigidly limited to a direction parallel to the axis of the rotor 1 but means a direction spiral of the axis of the rotor 1 having a large pitch.

Figure 7:
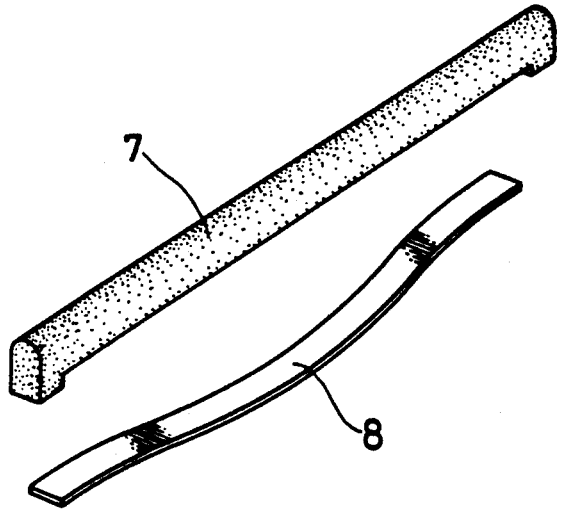
FIG. 7 provides perspective views of a radial seal and a leaf spring.
Figure 8:
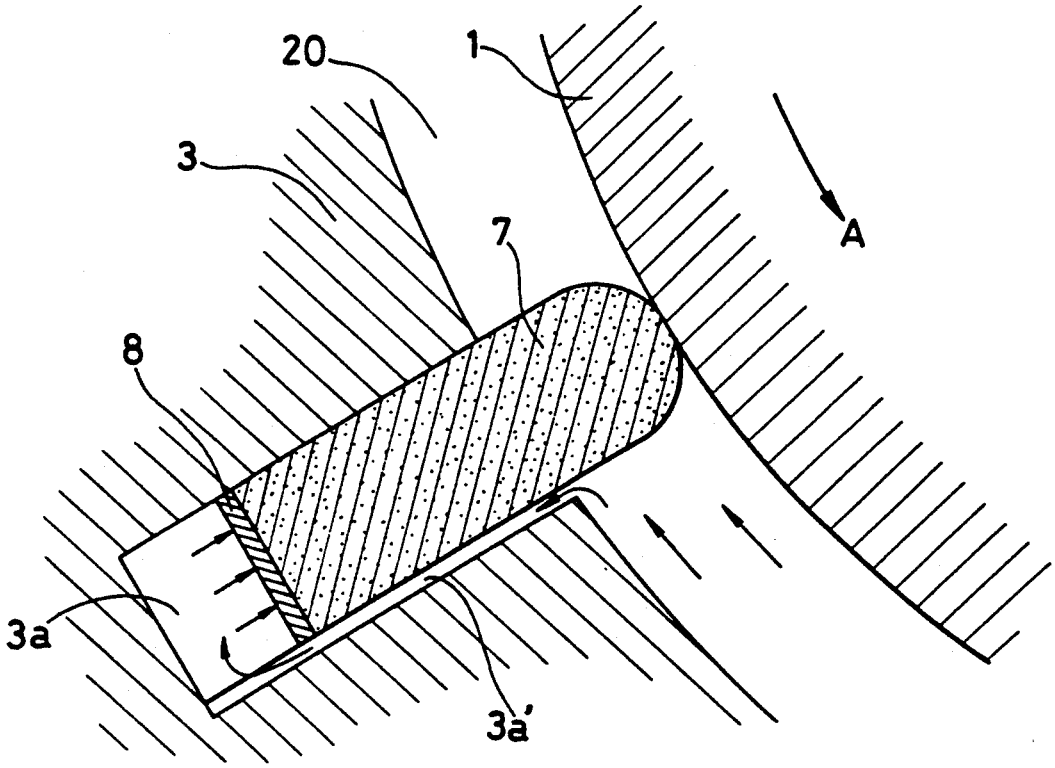
FIG. 8 is fragmentarily enlarged section of an arrangement of the radial seal and leaf spring of FIG. 7.

The radial seals 7*a* to 7*d* will be described in more detail with reference to FIGS. 4, 8 and 8 hereinafter. As seen in FIG. 7, each of the radial seals 7*a* to 7*d* has an arcuate e.g., a cylindrical, sliding-contact surface in an essentially tangential contact with the cylindrical surface of the rotor 1 so that a contact surface area of each of the radial seals 7*a* to 7*d* are as small as possible unless they impair sealing performances. As seen in FIG. 4, each of the grooves 3*a* receives a leaf spring 8 seated between the radial seal 7 and bottom of the groove 3*a*. Thus, the force of the leaf spring 8 urges the cylindrical sliding-contact surface of the radial seal 7 in press contact with the cylindrical surface of the rotor 1. As seen in FIG. 8, the radial seal 7 is seated on a side wall of the groove 3*a* situated downstream of a gas flow to be sealed and is separated from the opposite side wall of the groove 3*a* situated upstream of the gas flow with a clearance, or gap 3*a*' so that the gas flow passes through a clearance 20 between the cylindrical surface of the rotor 1 and opposite cylindrical surfaces of the engine cylinder head 3 and the clearance 3*a*' to the flat surface of the radial seal 7 opposite to the cylindrical sliding-contact surface of the radial seal 7 to produce a dynamic pressure adding to the force of the leaf spring 8. This dynamic pressure of the gas flow tends to increase when the total pressure of the gas flow increases in a case in which a high sealability is required. Each of the radial seals 7*a* to 7*d* is rod-shaped. Alternatively, they may be curve, e.g., arc-shaped.

Figure 5:
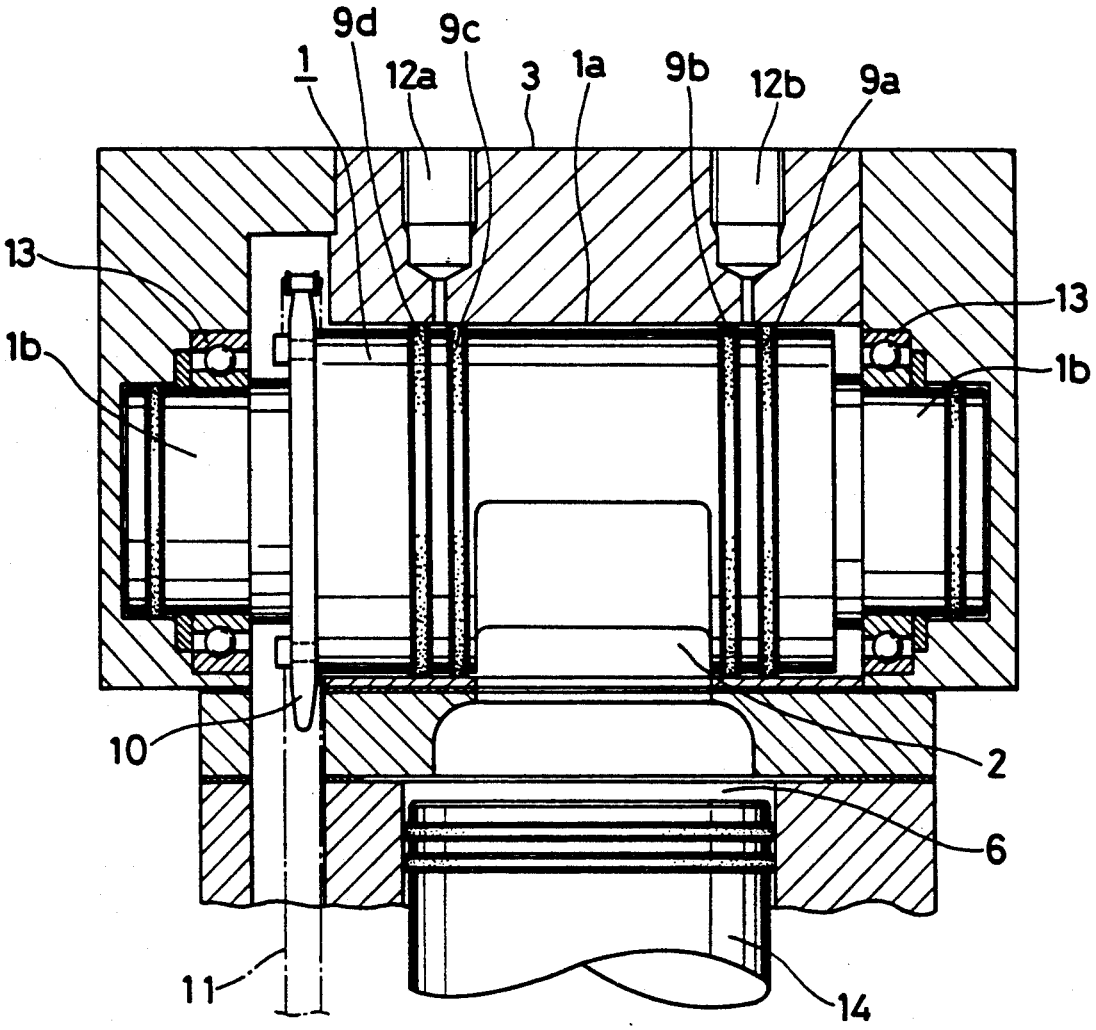
FIG. 5 is a longitudinal section of a rotary valve according to a first embodiment of the present invention serving as an intake and exhaust valve of an internal-combustion engine.

As seen in FIGS. 4 and 5, the annular seals indicated at 9*a*, 9*b*, 9*c* and 9*d* are placed in annular grooves defined in the cylindrical surface of the rotor 1. Two pairs of the annular seals 9*a* and 9*b* and annular seals 9*b* and 9*c* are situated to the opposite ends of the radial seals 7*a* to 7*d*. Each of the annular seals 9*a* to 9*d* may be, e.g., made of the same material and has the same shape as a piston ring fitting on the piston of a reciprocating engine.

In accordance with the first embodiment of FIGS. 4 and 5, all of the annular seals 9*a* to 9*d* fit on the rotor 1. Alternatively, at least one of them may be placed within a groove which may be defined in a cylindrical edge surface of the bore in the engine cylinder head 3 opposite to the cylindrical surface of the rotor 1. For example, the annular seals 9*b* and 9*c* may fit on the rotor 1 and on the other hand, the annular seals 9*a* and 9*d* may be placed within grooves which may be defined in the surfaces of the engine cylinder head 3. Of course, all of the annular seals 9*a* to 9*d* may be placed within the annular grooves which may be defined in a cylindrical edge surface of the bore of the engine cylinder head 3 opposite the cylindrical surface of the rotor 1.

FIG. 5 illustrates a rotary valve according to the first embodiment of the present invention serving as an intake and exhaust valve of an internal-combustion engine. The rotor 1 comprises a large-diametric cylindrical portion 1*a* providing a rotor body, and opposite small-diametric cylindrical portions 1*b* adjoining the opposite ends of the large-diametric portion 1*a*. Each of the opposite small-diametric portions 1*b* is supported on the cylindrical edge surfaces of the bore of the engine cylinder head 3 by means of a ball bearing 13. One end face of the large-diametric portion 1*a* has a sprocket wheel 10 which is driven by a engine crankshaft (not shown) through a chain 11. The sprocket wheel 10 and thereby the rotor 1 rotate at a ½ speed of the engine. The engine cylinder head 3 has lubricating ports 12*a* and 12*b*. A piston of the engine is indicated at 14.

FIGS. 6A, 6B, 6C, 6D, 6E and 6F illustrate the operation of the rotary valve with the radial seals 7*a* to 7*d* serving as an intake and exhaust valve of the internal-combustion engine. In FIGS. 6A to 6F, black radial seals of the radial seals 7*a* to 7*d* indicate radial seals fully sealing at least one of the intake 4, exhaust 5 and combustion chamber 6 and on the other hand, hatched radial seals indicate radial seals not sealing them. An illustration of the annular seals 9*a* to 9*d* is eliminated.

Figure 6:
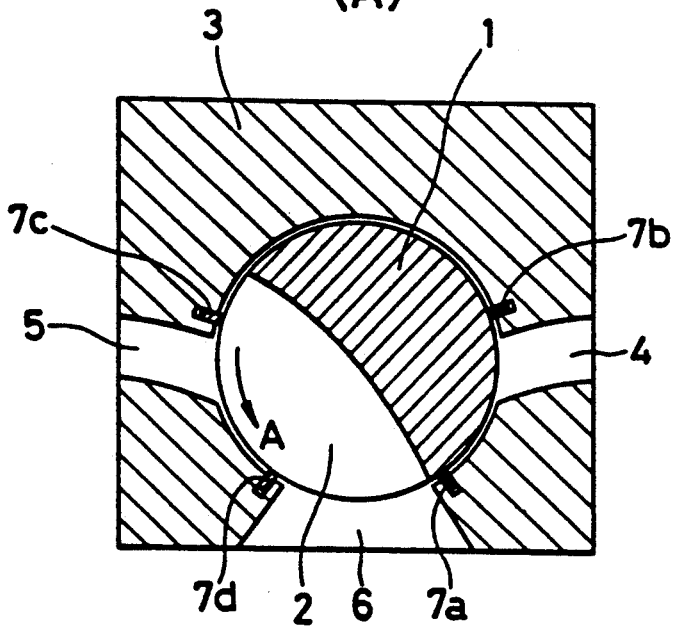
FIG. 6A is a schematic cross-section of the FIG. 5 rotary valve, indicating an exhaust stroke of the engine.
FIG. 6B is a schematic cross-section of the FIG. 5 rotary valve, indicating a transient state from exhaust stroke to intake stroke of the engine.
FIG. 6C is a schematic cross-section of the FIG. 5 rotary valve, indicating intake stroke of the engine.
FIG. 6D is a schematic cross-section of the FIG. 5 rotary valve, indicating compression stroke of the engine.
FIG. 6E is a schematic cross-section of the FIG. 5 rotary valve, indicating ignition stroke of the engine.
FIG. 6F is a schematic cross-section of the FIG. 5 rotary valve, indicating combustion gas inflation stroke of the engine.
Figure 6:
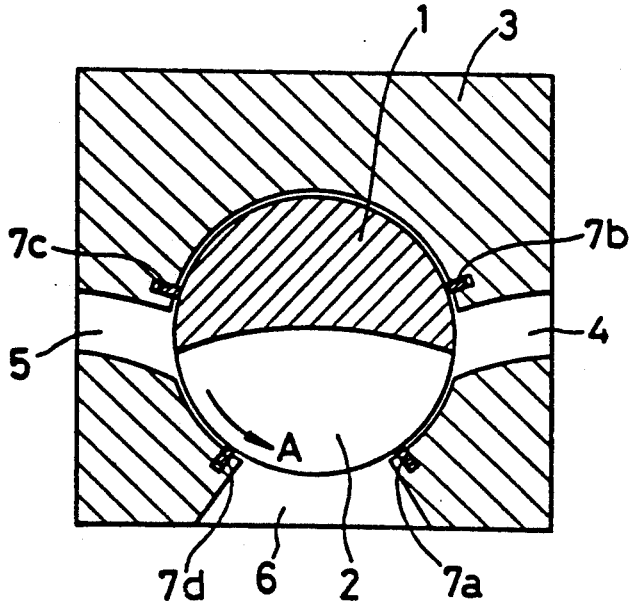
Figure 6:
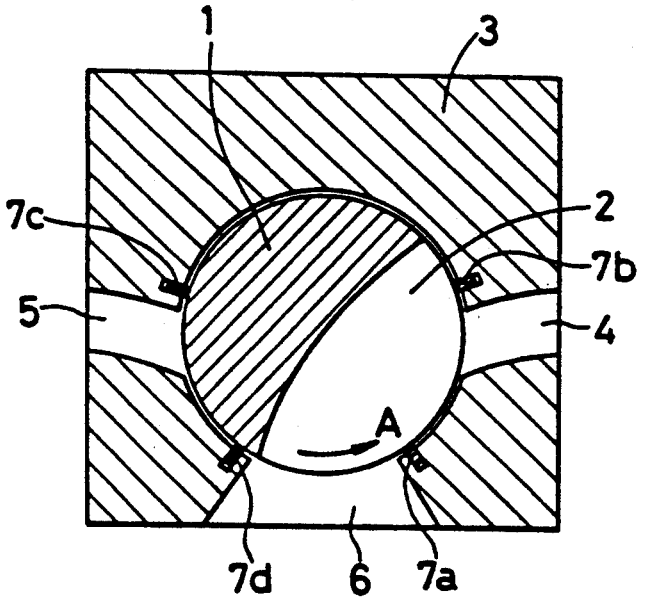
Figure 6:
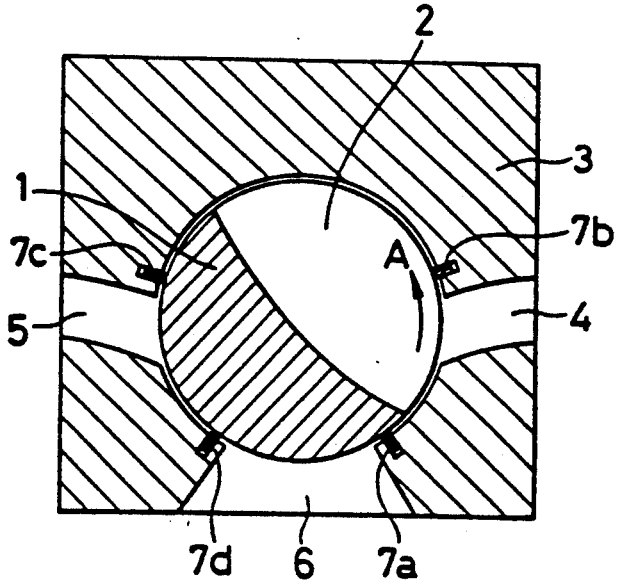
Figure 6:
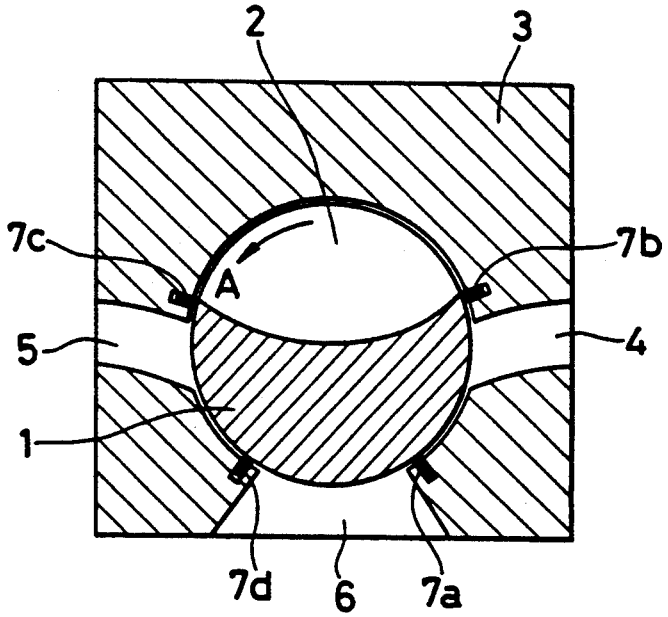
Figure 6:
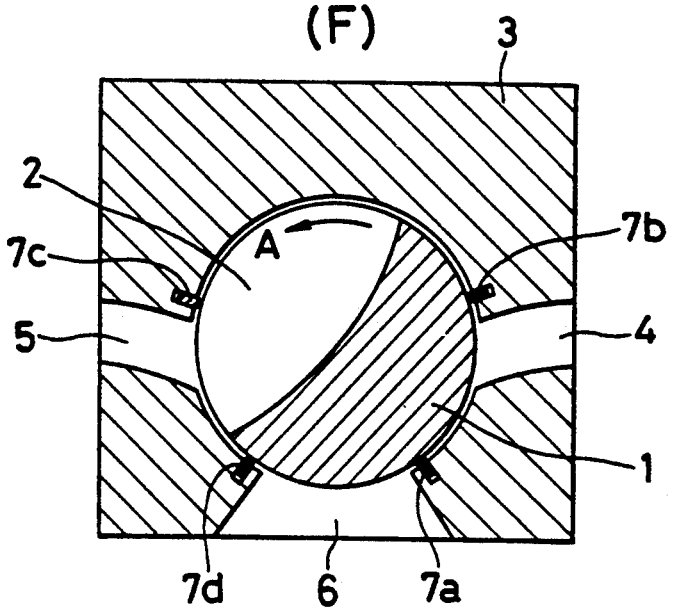

FIG. 6A illustrates a position of the rotary valve corresponding to exhaust stroke of the engine. The indentation 2 in the rotor 1 connects the combustion chamber 6 to the exhaust 5 so that the rotary valve exhausts the combustion chamber 6. The radial seals 7*a* and 7*b* seal the intake 4.

FIG. 6B illustrates a position of the rotary valve corresponding to a transient state from exhaust stroke to intake stroke of the engine so that the indentation 2 overlaps the intake 4, combustion chamber 6 and exhaust 5. None of the radial seals 7*a* to 7*d* seals the intake 4 and exhaust and 5 and combustion chamber 6.

FIG. 6C illustrates a position of the rotary valve corresponding to intake stroke of the engine. The indentation 2 in the rotor 1 connects the combustion chamber 6 to the intake 4 so that the rotary valve enables the engine to take combustible gas. The radial seals 7*c* and 7*d* seal the exhaust 5 to prevent a backflow of exhaust gas into the combustion chamber 6. In the case of a supercharged internal-combustion engine, e.g., by a turbocharger, the radial seals 7*c* and 7*d* a prevent pressure combustible gas to leak to the exhaust 5.

FIG. 6D illustrates a position of the rotary valve corresponding to compression stroke of the engine. The radial seals 7*a*, 7*c* and 7*d* seal the exhaust 5 and combustion chamber 6 so that the radial seals 7*a* and 7*d* fully shut off the combustion chamber 6 from the intake 4 and exhaust 5 and the radial seal 7*c* shuts a communication of the intake 4 and exhaust 5.

FIG. 6E illustrates a position of the rotary valve corresponding to ignition stroke of the engine. All of the radial seals 7*a* to 7*d* fully seal the intake 4, exhaust 5 and combustion chamber 6 so that the radial seals 7*b* and 7*c* double shut the communication of the intake 4 and exhaust 5 and the radial seals 7*a* and 7*d* shut off the combustion chamber 6 from the intake 4 and exhaust 5 to prevent combustion gas from leaking to the intake 4 and exhaust 5.

FIG. 6F illustrates a position of the rotary valve corresponding to combustion gas inflation stroke of the engine. The radial seals 7*a*, 7*b* and 7*d* shut off the combustion chamber 6 and intake 4 so that the radial seal 7*b* shuts the communication of the intake 4 and exhaust 5 and the radial seals 7*a* and 7*d* shut the combustion chamber 6 from the intake 4 and exhaust 5 to prevent combustion gas from leaking to the intake 4 and exhaust 5.

Since the positions of the sealed portions of the FIGS. 6A through 6F rotary valve are fixed between the intake 4, exhaust 5 and combustion chamber 6 in the cylindrical surfaces of the bore in the engine cylinder head 3, less radial seals can otherwise effectively operate. On the other hand, since if radial seals are attached to the rotor 1 the positions of the radial seals change with the rotation of the rotor having radial seals all attached thereto, more radial seals will be required. Of course, it is better that the number of radial seals is small since they produces a frictional resistance to the rotor.

Figure 9:
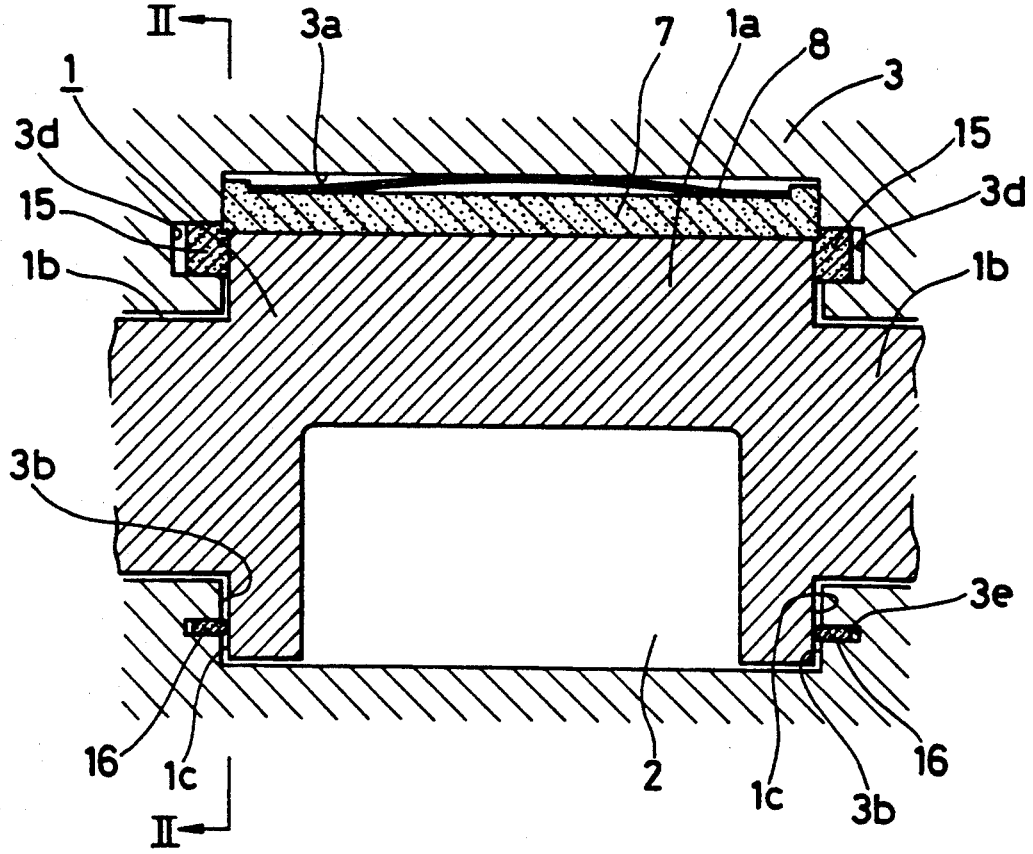
FIG. 9 is a longitudinal section of main part of a rotary valve according to a second embodiment of the present invention.
Figure 10:
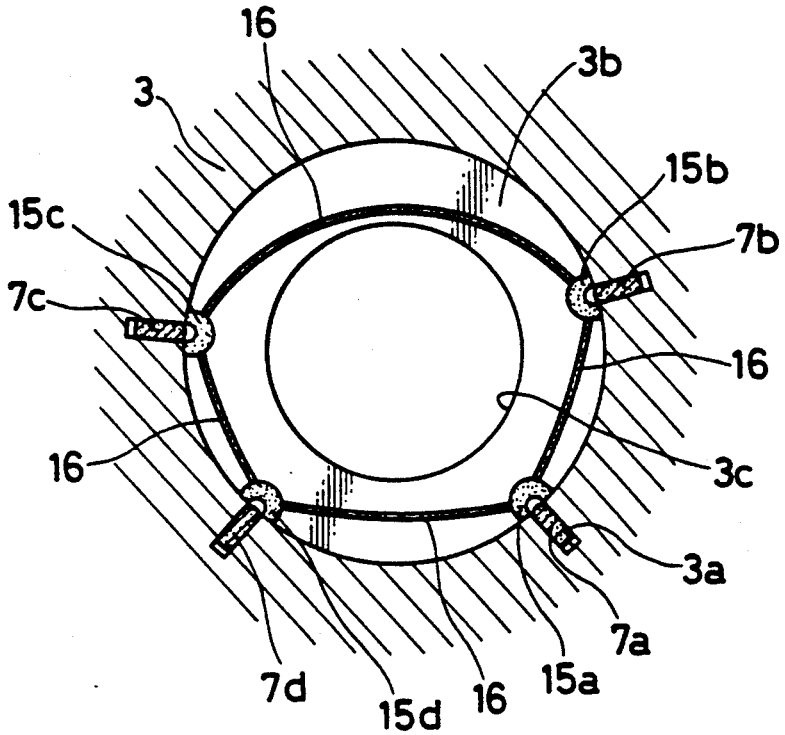
FIG. 10 is a cross-section taken along II—II line in FIG. 9.
Figure 11:
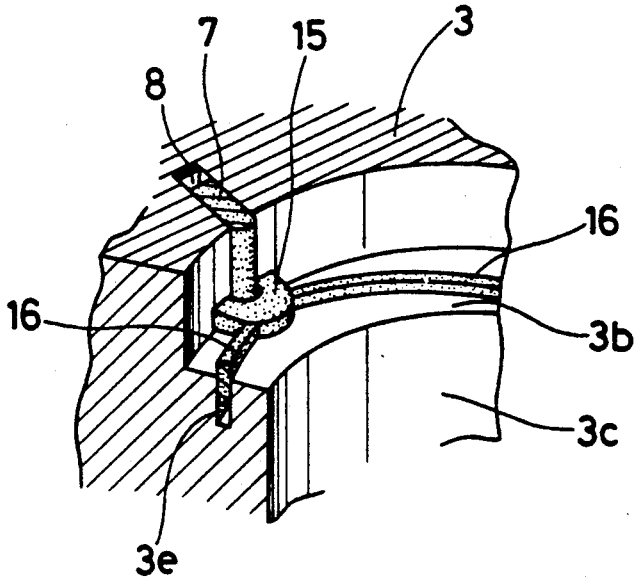
FIG. 11 is a fragmentary perspective view of an arrangement of a corner seal, radial seal and side seals in a valve casing.
Figure 12:
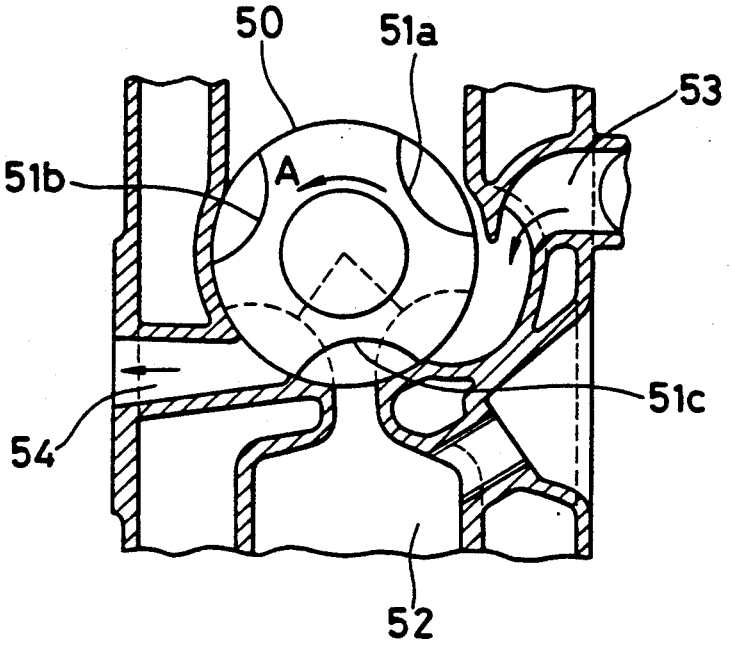
FIG.12 PRIOR ART
FIG. 12 is a fragmentary cross-section of a prior-art rotary valve.
Figure 13:
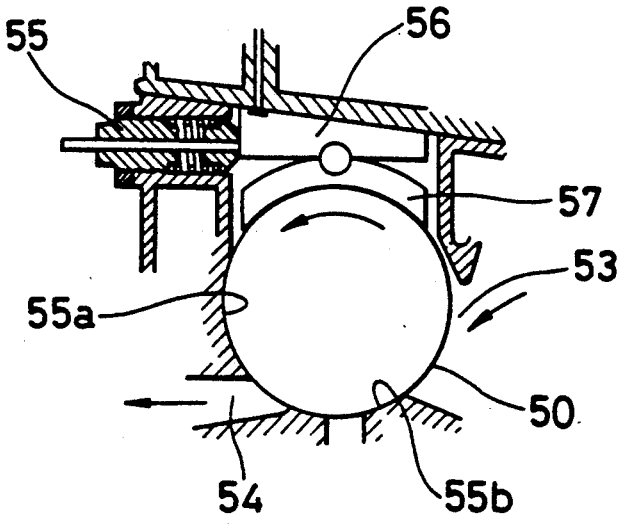
FIG.13 PRIOR ART
FIG. 13 is a cross-section of a sealing arrangement of the FIG. 12 rotary valve.

FIG. 9 through 11 illustrate a rotary valve according to a second embodiment of the present invention. This rotary valve comprises radial seals 7*a* to 7*d* and seals 15 and 16 placed in grooves 3*d* and 3*e* defined in the wall of a valve casing 3 instead of the annular seals 9*a* to 9*d*. The wall of the valve casing 3 defines opposite annular shoulders 3*b* around a bore 3*c* receiving the smaller-diametric portions 1*b* of the rotor 1 opposite to annular shoulders 1*c* defined between the larger-diametric portion 1*a* and smaller-diametric portions 1*b*.

As seen in FIGS. 10 and 11, each of the valve casing shoulders 3*b* has four semicircular corner seals 15*a*, 15*b*, 15*c* and 15*d* placed in the grooves 3*d* and receiving part of the radial seals 7*a* to 7*d* appearing near the valve casing shoulder 3*b*. Each of the valve casing shoulders 3*b* has four side seals 16 placed in the grooves 3*e* and connecting the corner seals 15*a* to 15*d*.

A pair of opposite seal assemblies of the four side seals 16 and four corner seals 15 seals an axial leak in a clearance between the valve casing 3 and rotor 1. A spring, i.e., a leaf spring, is seated between the rear surface of each of the corner seals 15*a* to 15*d* and side seals 16 and the bottom of each of the grooves 3*d* and 3*e* in essentially the same manner as in the case of the radial seals 7*a* to 7*d* of the first embodiment. Thus, the corner seals 15*a* to 15*d* and side seals 16 are in press contact with the shoulders 1*c* of the rotor 1. FIG. 9 eliminates an illustration of these springs.

As seen in FIG. 10, the assembly of the four side seals 16 is not circular so that each of the four side seals 16 has the shape of a circular arc with a different diameter. Thus, a track of the assembly of the side seals 16 formed on the rotor shoulder 1*c* has essentially the same width as the rotor shoulder 1*c*, so that a specified portion of the rotor shoulder 1*c* will not be quickly worn.

If a track of the assembly of the side seals 16 formed on the rotor shoulder 1*c* has the form of a single circle, then only a specified portion of the rotor shoulder 1*c* is in sliding contact with the assembly of the side seals 16. Thus, the sliding-contact surface of the rotor shoulder 1*c* is quickly worn, so that the operations of the side seals 16 will deteriorate.

If the rotary valve of the second embodiment does not have the FIG. 11 arrangement of fixedly engaging the corner seals 15*a* to 15*d* with the radial seals 7*a* to 7*d* but the corner seals 15*a* to 15*d* are arranged in sliding contact with the radial seals 7*a* to 7*d*, then the corner seals 15*a* to 15*d* and side seals 16 can be attached to the rotor shoulder 1*c*.

The above-described embodiments have described the rotary valve including the rotor 1 defining the single indentation. However, the present invention is also applicable to a rotary valve including a rotor defining a plurality of indentations. Alternatively, the present invention is also applicable to an axial flow type rotary valve in which a rotor includes an intake and an exhaust defined therein. Alternatively, a single sealing arrangement of seals extending axially of the rotor and seals extending circumferentially of the rotor may be attached to, e.g., a valve casing to seal clearances between the rotor and the valve casing. This single sealing arrangement may have a form adapted to the indentation in the rotor 1 and openings for intake and exhaust defined in a rotor of an axial flow type rotary valve, e.g., the form of an essentially square hollow pole in the case of the FIG. 1 rotor or the form of a hollow round cylinder in view of the sealability of the rotary valve and the formability of a seal material.

What is claimed is:

1. A rotary valve, comprising:

a casing having a wall defining a cylindrical bore having a cylindrical edge surface, a plurality of grooves extending substantially axially in said cylindrical edge surface, and said casing having a first opening for taking in a first gas, a second opening for discharging a second gas and a third opening communicating with a chamber, the chamber taking in the first gas and discharging the second gas;

a rotor including a cylindrical portion mounted within said bore with a predetermined clearance defined between a cylindrical surface of the cylindrical portion of said rotor and the cylindrical edge surface of said bore, said rotor including means for selectively fluidly connecting the first and second openings to the third opening;

first sealing means for sealing possible leaks in the first and second gases from the selectively fluidly connecting means in the axial direction of said rotor; and second sealing means for sealing possible leaks in the first and second gases from the selectively fluidly connecting means in the radial direction of said rotor;

said second sealing means comprising a plurality of radial seals mounted in said grooves of said casing and extending substantially axially of said rotor, each of said radial seals having an arcuate surface directed toward said rotor, and spring means for biasing each of said arcuate surfaces of said radial seals into substantially tangential contact with the cylindrical surface of said rotor, whereby frictional contact is minimized between said rotor and said radial seals.

2. The rotary valve of claim 1, wherein the first and second openings are situated on opposite sides of the third opening so that each of the first and second openings has a first edge near to the third opening and a second edge remote from the third opening, two of the radial seals are situated near opposite edges of the third opening which are adjacent the first edges of the first and second openings, one of the radial seals is situated near the second edge of the first opening and one of the radial seals is situated near the second edge of the second opening.

3. The rotary valve of claim 1 wherein said first sealing means comprises corner seals and side seals, each of the corner seals being attached to a surface of the casing wall opposite one of the opposite end surfaces of the rotor and fixedly engaging a corresponding one of the radial seals, each of the side seals being attached to said surface of the casing wall opposite one of the opposite end surfaces of the rotor, the side seals connecting the corner seals to form a sealing ring assembly.

4. The rotary valve of claim 1, wherein said first sealing means comprises corner seals and side seals, each of the corner seals and each of the side seals being attached to one of the opposite end surfaces of the rotor, the side seals connecting the corner seals to form a sealing ring assembly.

5. The rotary valve of claim 1, wherein said first sealing means comprises a plurality of annular seals attached to the cylindrical surface of the rotor.

6. The rotary valve of claim 3, wherein said first sealing means comprises a plurality of annular seals attached to the cylindrical surface of the rotor.

7. The rotary valve of claim 1 wherein:

each of said radial seals is loosely received in a respective one of said substantially axially extending grooves so that a first gap is provided between a side wall of each of said radial seals and a side wall of the corresponding substantially axially extending groove; and a second gap is provided between the bottom of each of said radial seals and the bottom of the corresponding substantially axially extending groove, whereby when a gas under pressure enters said first and second gaps, said gas applies a force to said side wall of said radial seal and to said bottom of said radial seal to dynamically press another side wall of said radial seal against another side wall of said axially extending groove and said arcuate surface of said radial seal against the cylindrical surface of said rotor with a force proportional to the pressure of the gas to proportionally increase the sealability of said radial seal.

8. The rotary valve of claim 7 wherein said rotor comprises a cylindrical rotor body of a first diameter and a pair of oppositely situated cylindrical ends of a second diameter smaller than said first diameter, said rotor body and said ends being integrally formed from the same material.

9. The rotary valve of claim 8 wherein said casing further comprises means for journalling said pair of cylindrical rotor ends to support said rotor for rotation within said cylindrical bore and to maintain said predetermined clearance defined between the cylindrical surface of said rotor and the cylindrical edge surface of said bore.

10. The rotary valve of claim 9 wherein said journalling means comprises ball bearings for journalling said pair of cylindrical rotor ends.

11. The rotary valve of claim 7 wherein said fluidly connecting means comprises an indentation in said rotor body.

12. The rotary valve of claim 10 wherein said fluidly connecting means comprises a single indentation defining radially extending end surfaces and an arcuate surface connecting said radially extending end surfaces.

13. The rotary valve of claim 7 wherein said rotor further comprises drive means mounted thereon for rotatably driving said rotor.

14. The rotary valve of claim 7 wherein said first sealing means comprises corner seals and side seals, each of the corner seals being attached to a surface of the casing wall opposite one of the opposite end surfaces of the rotor and fixedly engaging a corresponding one of the radial seals, each of the side seals being attached to said surface of the casing wall opposite one of the opposite end surfaces of the rotor, the side seals connecting the corner seals to form a sealing ring assembly.

15. The rotary valve of claim 7, wherein said first sealing means comprises corner seals and side seals, each of the corner seals and each of the side seals being attached to one of the opposite end surfaces of the rotor, the side seals connecting the corner seals to form a sealing ring assembly.

16. The rotary valve of claim 1 wherein said spring means comprises a leaf spring.

* * * * *